United States Patent [19]

Baglio

[11] Patent Number: 4,832,290

[45] Date of Patent: May 23, 1989

[54] SEPARATE HANGER FOR FLEXIBLE PLASTIC BAGS

[76] Inventor: Thomas P. Baglio, 3657 Tierra de Dios, Escondido, Calif. 92025

[21] Appl. No.: 101,974

[22] Filed: Sep. 28, 1987

[51] Int. Cl.[4] ..... B65B 67/12

[52] U.S. Cl. ..... 248/95; 248/311.2

[58] Field of Search ..... 248/95, 99, 101, 311.2, 248/311.3, 318, 312, 340; 211/88, 71; 223/95

[56] References Cited

U.S. PATENT DOCUMENTS

| | | | |
|---|---|---|---|
| 1,286,940 | 12/1918 | Cerny | 248/95 |
| 1,899,942 | 3/1933 | Claflin | 211/48 X |
| 2,287,473 | 6/1942 | Glines | 223/95 X |
| 2,447,771 | 8/1948 | Rogers | 248/95 X |
| 2,816,667 | 12/1957 | Tanay | 248/312 X |
| 3,001,678 | 9/1961 | Maxwell | 248/312 X |
| 4,325,486 | 4/1982 | Neal | 211/71 |
| 4,540,146 | 9/1985 | Basile | 248/318 X |
| 4,700,849 | 10/1987 | Wagner | 211/71 |

FOREIGN PATENT DOCUMENTS

| | | | |
|---|---|---|---|
| 1347666 | 2/1974 | United Kingdom | 211/45 |

*Primary Examiner*—J. Franklin Foss

*Attorney, Agent, or Firm*—Dressler, Goldsmith et al.

[57] ABSTRACT

This invention provides a means of hanging or supporting, flexible plastic bags which have an increased thickness of plastic near the top of the bag. This increased thickness may be processed into the bags for many reasons including, but not limited to; closure mechanisms such as the rib and groove bag closures, handle ridges along the top of the bag, or ridges of slightly thicker plastic wall at the top of the bag due to bag processing methods.

The invention consists of rigid rails on each side of a slot or slots. This slot is wide enough for the thin sides of the plastic bag to pass through but not the greater width of the plastic at the point of increased thickness near the top of the bag. Thus, once inserted, the bag and its contents hang suspended downward from between the rails. The rails can be attached and adjacent to other rails and slot members forming a multiple bag hanger, or there may be only one set of rails with one slot between them, joined by a bridging of some rigid material and allowing the hanging of only one bag. The slot and the rails may be long enough to allow the whole top of the bag to slide, lengthwise, into the slot with some overlap for security. At least one end of the hanger shall be open to receive the bag. The end(s) which are intended to receive the bag may be flared or in some other way enlarged to aid in starting the slide of the plastic wall of the bag into the slot. The hanger would have some means of attaching it to another surface, either removably with a hook or loop on its upper surface intended to allow it to be hung from a bar, rack, or shelf of some kind, or more rigidly as with a multiple hanger clamped under a shelf or fastened with screws or bolts. In this case one end of all the slots would be left open for insertion and removal of bags.

8 Claims, 1 Drawing Sheet

FIG. 1
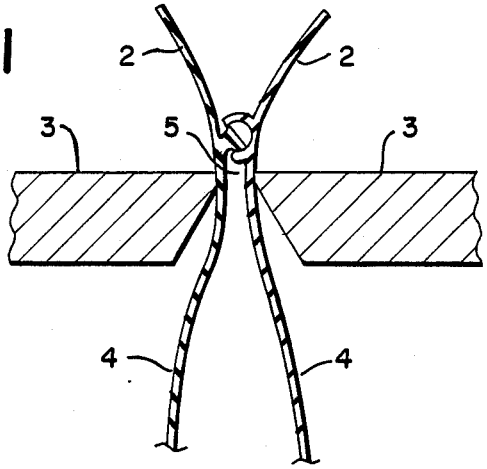
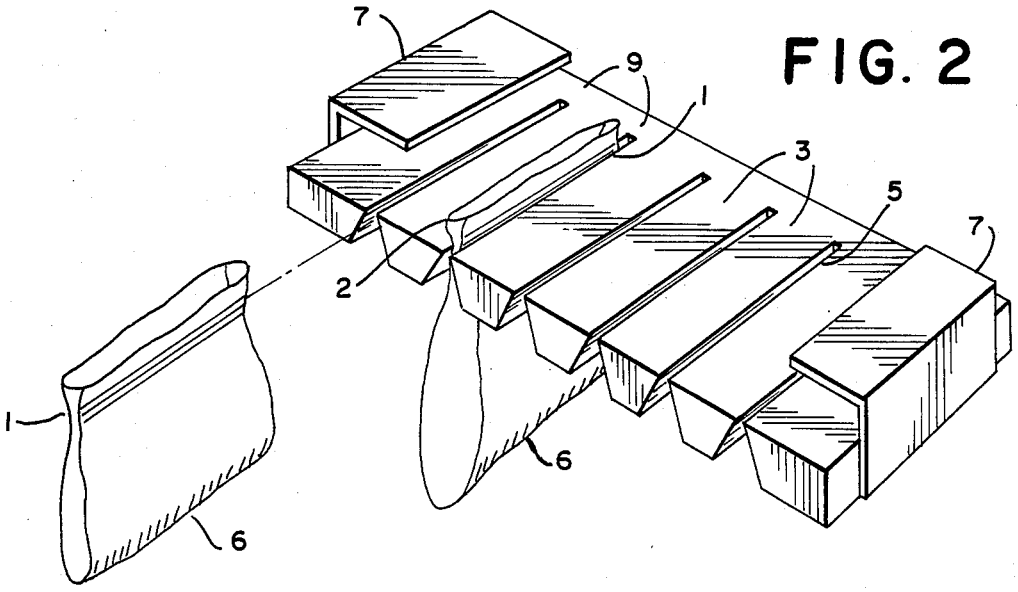
FIG. 2
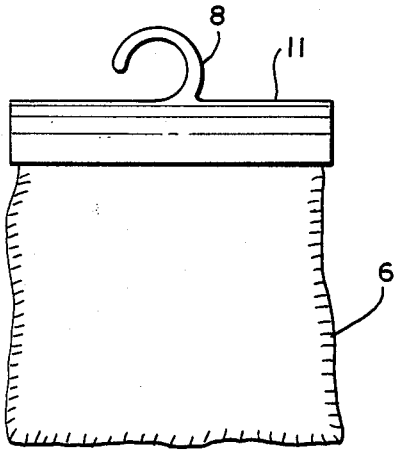
FIG. 3
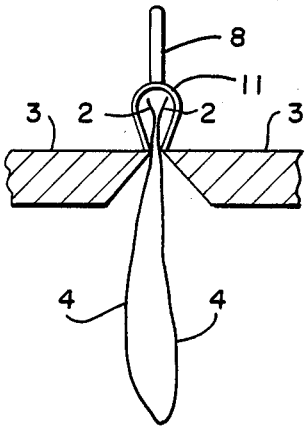
FIG. 4

SEPARATE HANGER FOR FLEXIBLE PLASTIC BAGS

BACKGROUND OF THE INVENTION

Flexible plastic bags have long been used for storage of various contents including, but not limited to: food, hardware, clothes, chemicals, paper goods and many others. Many of these bags, for one reason or another, have had additional thickness of material near the top of the bag. One common reason for an additional thickness is an interlocking rib and groove bag closure mechanism near the top of the bag.

It was previously known that unless a bag had an integral hanger or a hole in the bag associated with a hanger it was necessary to store these bags and their contents by laying them on something. This method of stocked storage takes considerable space and is correspondingly inefficient. The contents of the bag are not easily viewed.

It is also known to store bags vertically by hanging them from a rack or support. In this case the bags exhibited a perforation of the bag or an integral attached hanger. Because their was no complementary interation of the bags closure and the hanging mechanism, the freshness of the bags' contents was not assured.

Furthermore in the prior art the bags were not necessarily reliably removable from their hangers, openable and closable, and returnable to the same hanger several times without undue wear or deterioration resulting in leakage of the bags' contents.

SUMMARY OF THE INVENTION

This invention is embodied in a hanger system including a hanger rack assembly that supports a flexible plastic bag having an additional thickness at or near the top of the bag. This additional thickness of material is preferably plastic used in molding a rib and groove type closure mechanism. The additional thickness of material may alternatively be a plastic, typically molded, attached handle mechanism. The handle mechanism has a channel with an interior that clasps the bag. The exterior of the hanger mechanism forms a hanger hook. The hanger hook permits hanging of the bag.

In the preferred embodiment of the invention, the additional thickness of the bag is supported by properly spaced rails of a bag hanger rack assembly. The rails are positioned along each side of the bag preferably along the entire length of its top. The hanger rack assembly's rails thus define each side of a suitably sized slot for holding the bag. The rails are held rigidly in proper relation to each other by bridging material. This bridging material is either at the rear or on the top of the hanger assembly in a position not interfering with support or removal of the bag.

The use of the hanger system is as follows: A flexible plastic bag which has the required additional thickness at or near its top is opened, contents are placed inside the bag and the bag is then closed, preferably along a rib and groove closure mechanism. The bag is then slid into the slot of the hanger rack assembly so that the extra thickness of the bag is above the rails of the hanger rack assembly. The hands release the bag, allowing the suspended hanging support of the bag and its contents to be assumed by the rails of the hanger rack assembly.

The inward pressure of the hanger assembly rails on each side of the bag at the level of its additional thickness will tend to press the edges of the bag tightly closed, thereby reliably sealing the bag.

BRIEF DESCRIPTION OF THE DRAWINGS

FIG. 1 is a cross sectional view showing the hanger rack assembly having rails defining a slot, and an included flexible plastic bag, of the hanger system of the present invention.

FIG. 2 is a top-front-right perspective view of a multiple bag hanger rack assembly, including the attaching brackets to mount the hanger rack assembly, and one bag hanging, of the hanger system of the present invention.

FIG. 3 is a side view sharing an individual, single bag hanger hook mechanism affixed to a bag wherein the hanger hook mechanism and its bag are compatibly employed in the hanger system of the present invention.

FIG. 4 is an end cross sectional view showing the individual, single bag hanger hook affixed to a bag hanging from the hanger-rack assembly shown in FIGS. 1 and 2.

DETAILED DESCRIPTION OF THE INVENTION

The present invention is embodied in a hanger system having a hanger rack assembly for hanging or supporting in a vertical position flexible plastic bags having a suitable additional thickness at or near the top of the bag.

The invention consists of rigid rails on each side of a slot or slots. This slot is wide enough for the thin sides of the plastic bag to pass through but not the greater width of the plastic at the point of increased thickness near the top of the bag. Thus, once inserted, the bag and its contents hang suspended downward from between the rails. The rails can be attached and adjacent to other rails and slot members forming a multiple bag hanger, or there may be only one set of rails with one slot between them, joined by a bridging of some rigid material and allowing the hanging of only one bag. The slot and the rails may be long enough to allow the whole top of the bag to slide, lengthwise, into the slot with some overlap for security. At least one end of the hanger shall be open to receive the bag. The end(s) which are intended to receive the bag may be flared or in some other way enlarged to aid in starting the slide of the plastic wall of the bag into the slot. The hanger would have have some means of attaching it to another surface, either removably with a hook or loop on its upper surface intended to allow it to be hung from a bar, rack, or shelf of some kind, or more rigidly as with a multiple hanger clamped under a shelf or fastened with screws or bolts. In this case one end of all the slots would be left open for insertion and removal of bags.

The hanger rack assembly defines rigid rails such as labeled number 3 in FIGS. 1 and 2. These rails border and wall a slot between them such as that labeled number 5 in FIGS. 1 and 2. This slot is of the proper width that will just allow two thicknesses of the plastic bag wall material labeled number 4 in FIGS. 1 and 4 to pass down the slot. The rails are of sufficient length to allow the entire length of the top of the bag to be slid between them as is demonstrated by their length shown in FIGS. 2 and 3.

The edges of the rails in contact with the walls of the plastic bag are smooth to avoid cutting the bag, but sharp enough to grasp the extra thickness of the plastic labeled number 1 in FIGS. 1 and 2. This bulk of additional thickness rests on the rails along the whole length of the top of the bag as is shown in FIG. 2. The top of the bag, labeled number 2 in FIGS. 1, 2, and 4 is free to stick out on top of the rails and the content holding portion of the bag labeled number 6 in FIGS. 2 and 3 hangs below the rails.

The bag may be removed and replaced from the hanger by sliding it out or into the slot between the rails. The rails are held in relation to each other by a bridge of material from one rail to another. This bridge can be over the top of the hanger or at the rear of the hanger as is labeled number 9 in FIG. 2. In the case of a top bridge it is sufficiently wide, high, and far enough away from the rail edges to allow room inside it for the plastic bag, the bag attachment mechanism 8 (to be discussed) and the loose edges of the bag. Alternately, there may be a several slots with common rails on each side and joined together by a common rear bridge. This type of hanger is for multiple bag storage.

The invented hanger, system also accords for a form of hanging or attachment mechanism to be added to it to also clasp the bag. This mechanism allows the bag 2 to be supported by something other than the hanger rack assembly when it is withdrawn therefrom. The top of this type of hanger mechanism may have an open or a closed loop which allows hanging of the hanger mechanism and its supported bag 1 from a rack or a rod of some kind (not shown) and allowing both the hanger mechanism 11 and the supported bag to be removed, either separately, or together from the hanger rack assembly 3. This mechanism 14 is preferably has an open loop type hanging device attached to the bag 2 such as the upper side hanger hook that is labeled number 8 in FIGS. 3 and 4.

I claim:

1. A hanger system comprising:

a flat hanger rack assembly having a plurality of longitudinally extending rails defining between adjacent ones of such rails a plurality of slots; and a plurality of flexible plastic bags, each closing so that it is thickened upon closure along a closure line near a boundary of the bag, hung from the hanger rack assembly at its plurality of slots;

wherein each bag's thickened closure line allows it to be suspended from a slot of the hanger rack assembly by this thickness resting on adjacent rails of the hanger rack assembly;

wherein each bag is maintaned closed along its closure line when suspended from a slot of the hanger rack assembly by proximity to adjacent rails.

2. The hanger system according to claim 1 further comprising:

a plurality of detachable hanger hook-members defining channels that slide over the plurality of flexible plastic bags so as to embrace the thickened closure lines of the bags within the channels' interiors and so therein retain the bags to the members without requiring any perforation of the bag or permanent bonding to the material of the bag by the hook member;

wherein retention of the plurality of bags by the plurality of hanger hook members does not interfere that each bag is hung from the hanger rack assembly;

wherein each of the plurality of hanger hook members presents at its channel exterior a hook that permits the member and the bag retained thereto to be hung from the hook upon such times as the bag is not hung from the hanger rack assembly.

3. An apparatus which supports plastic bags vertically comprising:

a hanger rack having horizontal rails defining slots for catching in a slot and supporting on adjacent rails a hanging plastic bag along a closure line of the bag where it is thickened due to closure; and a plastic bag constructed and intentionally designed so as to become thickened along a closure line upon being closed along such closure line;

wherein the bag is supported by hanger rack rails on each side of a slot when closed along its closure line, maintained closed when supported by the hanger rack by inward pressure of the supporting rails on each side of the bag's closure line forcing the sides of the bag together, and removable and replaceable from its maintained-closed supported position by sliding in and out of the hanger rack slot.

4. The apparatus according to claim 1 wherein the ends of the hanger rack's rails are flared to allow easier sliding insertion of the plastic bag into the slot.

5. A dual retention and dispensing system for a flexible bag that closes along a closure line to produce a thickened region to the bag, the system comprising:

a retention-rack member having at least two elongated longitudinally-extending spaced parallel rigid rails defining a slot therebetween which is open to one end, the retention-rack member capable of hanging vertically a workpiece flexible bag in its slot by suspension from its rails;

a retention-hanger member defining a downwards directed narrowed opening horizontal channel and having an upwards extending hook opposite the channel the retention-hanger member capable of clasping the workpiece flexible bag within its channel simultaneously that the flexible bag is hanging from the retention-rack member;

wherein the workpiece flexible bag is slid within the retention-rack member's slot to be thereafter retained hanging vertically by suspension of its thickened closure line region upon the retention-rack member's rails;

wherein the same workpiece flexible bag may be, simultaneously to being retained hanging vertically from the retention-rack member, slid within the retention-hanger member's channel and thereafter retained therein by action of its thickened closure line region being clasped within the retention-hanger member's channel's narrow opening;

wherein the workpiece flexible bag as retained within the retention-hanger member's channel may be withdrawn from the retention-rack member's slot and thereafter hung by the retention-hanger member's hook;

whereby flexibility in the retention and dispensing of flexible bags is presented.

6. The retention and dispensing system according to claim 5 wherein the retention-rack member's rails hold closed the workpiece flexible bag that is slid within the retention-rack member's slot.

7. The retention and dispensing system according to claim 5 wherein the retention-hanger member's narrowed opening horizontal channel holds closed the workpiece flexible bag that is slid within the retention-hanger member's channel.

8. The retention and dispensing system according to claim 5 wherein the entire retention-hanger member, including its entire channel, is positioned above the rails of the retention-rack member when both the retention-rack member is hanging the workpiece flexible bag while the retention-rack member is clasping the same workpiece flexible bag.

* * * * *